United States Patent [19]

Smith et al.

[11] Patent Number: 4,601,795

[45] Date of Patent: Jul. 22, 1986

[54] ALLOY COATING METHOD

[75] Inventors: Gerald R. Smith, Columbia; John E. Allison, Jr., Bowie, both of Md.

[73] Assignee: The United States of America as represented by Secretary of Interior, Washington, D.C.

[21] Appl. No.: 716,789

[22] Filed: Mar. 27, 1985

[51] Int. Cl.[4] ..... C25D 5/50; C25D 15/00

[52] U.S. Cl. ..... 204/16; 204/37.1

[58] Field of Search ..... 204/16, 37.1

[56] References Cited

U.S. PATENT DOCUMENTS

| | | | |
|---|---|---|---|
| 3,061,525 | 10/1962 | Grazen | 204/16 |
| 3,666,636 | 5/1972 | Tomaszewski | 204/16 |
| 3,672,970 | 6/1972 | Tomaszewski | 204/16 |
| 3,745,098 | 7/1973 | Brown | 204/181.5 |
| 3,892,637 | 7/1975 | Polti | 204/37.3 |
| 3,904,490 | 9/1975 | Shigeru | 204/16 |
| 4,085,010 | 4/1978 | Ishimori | 204/16 |

FOREIGN PATENT DOCUMENTS

| | | | |
|---|---|---|---|
| 1358538 | 7/1974 | United Kingdom | 204/16 |

*Primary Examiner*—T. M. Tufariello

*Attorney, Agent, or Firm*—E. Philip Koltos; Thomas Zack

[57] ABSTRACT

A method of coating a metal substrate with a ternary or greater alloy of a predetermined composition is disclosed. Initially, a first and second metals are electrodeposited on the substrate using an aqueous electrolyte. At least one metal powder is simultaneously mixed in the electrolyte as the first and second metals are electrodeposited so that a portion of the metal powder is occluded in the electrodeposited metal coating. The rate of occlusion of the metal powder is controlled by the volume percent of the metal powder in the electrolyte. Finally, the metal coating and substrate are heat treated to diffuse the occluded metal powder in the coating and to form the desired alloy coating. A plurality of metal powders can be mixed in the electrolyte according to the present method. In addition, a diffusion barrier coating can be initially provided on the metal substrate. The method is particularly useful with iron-based metals such as stainless steel. The rate of occlusion of the metal powder is additionally controlled for iron-based metals using an iron-nickel plating solution by controlling the presence of reducible ferrous ions. The microstructure of the electrodeposited coating also affects the occlusion rate. The rate of occlusion was also increased by varying the current density.

12 Claims, 5 Drawing Figures

ALLOY COATING METHOD

FIELD OF THE INVENTION

The present invention relates generally to the placing of an alloy coating on a metal substrate, and more particularly to the electrodeposition of at least two metals and an occluded metal powder on a substrate and the subsequent heat treatment of the deposited coating to form a desired alloy coating.

BACKGROUND OF THE INVENTION

Metals such as chromium, cobalt, and manganese are used in corrosion, wear and high-temperature resistance alloys. Besides being expensive, metals of this type are not readily available nationally, thereby requiring stockpiling and importation. All of these factors result in a need for conservation of these metal reserves and resources which can be accomplished by more efficient utilization of existing resources and reserves.

One method of conserving metals of this type is to provide an alloy coating of a desired metal alloy on an underlying substrate in lieu of making the entire product of the desired alloy. Preparation of alloy coatings currently involves techniques such as physical vapor deposition (including evaporation, ion plating and sputtering), chemical vapor deposition, thermal spraying, and electrodeposition. Physical vapor deposition is the most versatile of these techniques, enabling the preparation of a large number of alloy compositions.

However, physical vapor deposition techniques have some disadvantage in that they require expensive, sophisticated vacuum, power and automatic control equipment in order to operate effectively. Additionally, physical vapor deposition coatings prepared on complex-shaped objects exhibit either poor line of sight coverage using an evaporation procedure or generally nonuniform thickness distribution using ion plating and sputtering techniques. All physical vapor deposition processes exhibit poor throwing power into deep recesses. Chemical vapor deposition has been shown not to be a practical process for depositing metallic alloys. It has been used most successfully in the preparation of semiconductor and insulator type coatings. The thermal spraying process has been used successfully in the deposition of numerous alloys but is not applicable for coating complex shaped objects or for plating into deep recesses.

The electrodeposition of cermet coatings has been disclosed in the prior art. This cermet technology involves the occlusion of a ceramic oxide, nitride, carbide, or boride in an electrodeposit to improve the oxidation or erosion resistance of the metal. Prior art patents disclosing cermet electrodeposition include the following: German Offer No. 2,611,857, Dec. 9, 1976 (Brown and Tomaszewski) "Electrodeposition of Particles Dispersed in Solution"; German Offer No. 2,217,778, Oct. 25, 1973 (Brown and Tomaszewski) "Cathodic Deposition of Small Water-Insoluble Particles on Metal Surfaces"; U.S. Pat. No. 3,745,098 (Brown and Tomaszewski). "Electrodeposition of Films of Fine Particles on Cathodes"; U.S. Pat. No. 3,061,525 (Grazen) "Method for Electroforming and Coating"; U.S. Pat. No. 3,672,970 (Tomaszewski) "Electrolytic Codeposition of Copper with Fine Particles"; and U.S. Pat. No. 3,666,636 (Tomaszewski and Tomaszewski) "Electrolytic Codeposition of Fine Particles With Copper."

In U.S. Pat. No. 3,892,637 (Polti), a hard and wear resistant coating is imparted to a finished article of copper by electrodepositing on the surface of the finished article a layer of a tin alloy containing antimony. This article is then heated to diffuse the base and coating metals into each other. The dispersing of a powder in a plating solution is also disclosed in U.S. Pat. No. 4,085,010 (Ishimori, et al.) and in U.S. Pat. No. 3,904,490 (Shigeru, et al). As disclosed in the Ishimori, et al., patent, a number of methods have been proposed to thoroughly disperse the powder in the solution including mechanical agitation of the coating bath, vibration of the object to be coated, and agitation of the bath with bubbles of air. The general use of heat treatment to effect a metal coating has also been disclosed in the following U.S. Pat. Nos.: 1,567,625 (Smith); 1,630,449 (Pilling); 3,505,181 (Marshall); and 3,755,090 (Jackson, et al).

Two other prior art articles of interest are the following: Kilgore, C. R., "Engineered Composite Coatings," *Products Finishing,* Vol. 27, No. 8, 1963, pp. 34–40; and Williams, R. V., "Electrodeposited Composite Coatings," *Electroplating and Metal Finishing,* Vol. 19, March 1966, pp. 92–96. These articles mention the possibility of forming alloys by codepositing a powder with an electroplate and the subsequent heat treatment of the coating to give an alloy composition. The former article suggests that a nichrome alloy can be produced while the latter suggests that an iron-nickel-chromium alloy can be produced. It has also been disclosed to electroplate a single metal alloy with the occlusion of a single metal powder. However, there was devised no reliable method for depositing an alloy coating of pre-determined composition on a metal base and particularly a ternary or greater alloy coating.

SUMMARY OF THE INVENTION

In accordance with the present invention, a method of coating a metal substrate with an alloy of a predetermined composition is provided. First and second metals are electrodeposited on the substrate using an aqueous electrolyte. A metal powder is mixed in the electrolyte as the first metal is electrodeposited so that a portion of the metal powder is occluded in the electrodeposited metal coating. The rate of occlusion of the metal powder is controlled by controlling the volume percent of the metal powder in the electrolyte. By controlling the amount of first and second metals in the electrolyte and the amount of metal powder dispersed in the electrolyte, it is possible to control the composition of the alloy coating. The current density also can be used to control the composition of the alloy coating. The composition of the alloy coating is controlled by obtaining data similar to the data obtained for the Fe, Ni, and Cr alloy system that is disclosed in this application and using that data to set the electrolyte composition of the ingredients.

Further, the occlusion is affected by the current density. As the current density increases from 2.0 to 5.0 $A/dm^2$, it is noted that the rate of occlusion of the Cr powder doubles. This is for 20 mol pct Fe, 80 mol pct Ni electrolyte system. As can be noted, the above values would vary for a different electrolyte system.

In addition, this variation in the effect of the control parameters will vary from system to system including other ternary, quaternary and greater alloy system.

Accordingly, the control parameters have to be determined as was done in this application for the Fe, Ni, and Cr alloy system. Finally, the metal coating is heat treated to diffuse the occluded metal powder in the coating.

According to a preferred embodiment of the present invention, a plurality of metal powders is mixed in the electrolyte so that a portion of the plurality of metal powders is occluded. In addition, a diffusion barrier coating is provided on the metal substrate prior to electrodeposition where it is desired to control excessive interdiffusion.

Preferably, the mixing of the metal powder in the electrolyte provided by a mechanical stirring of the electrolyte. The present invention is particularly adapted for coating an iron-based metal, especially stainless steel. A suitable coating includes an iron-nickel plating solution and a metal powder of chromium. The rate of occlusion of the chromium powder is additionally controlled by controlling the presence of reducible ferrous ions with regard to the microstructure of the alloy to be electrodeposited. The metal powder is also preferably inert to the electrolyte.

It is an advantage of the present invention that alloy coatings can be prepared having a composition and quality that are very difficult, if not impossible, to achieve by conventional methods. Consequently, the present invention has application to a wide segment of the alloy industry.

It is also an advantage of the present invention that inexpensive substrates can be provided with an alloy coating to replace bulk forms of these alloys. Consequently, more efficient use of alloy metals is achieved.

It is a further advantage of the present invention that a variety of alloy coatings can be applied to complex shapes and that objects can be prepared by electroforming.

Still another advantage of the present invention is that uniform compositions can be maintained throughout the alloy coating and that alloy coatings above 25 μm in thickness can be achieved.

The efficiency of the method of the present invention may also exceed 100 percent efficiency, that is, the maximum attainable by electrodeposition alone.

Other features and advantages of the present invention are stated in or apparent from a detailed description of a presently preferred embodiment of the invention found herein below.

DETAILED DESCRIPTION OF THE PREFERRED EMBODIMENT

Figure 1:
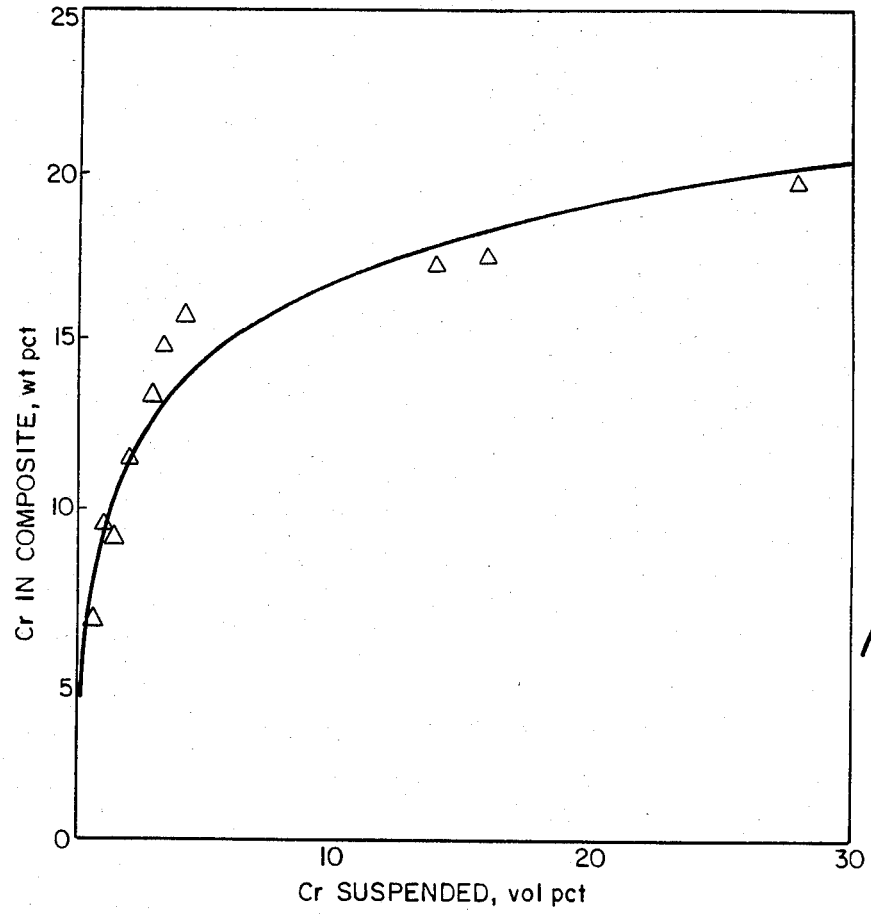
FIG. 1 is a graphical representation of the weight percent of chromium particles deposited as a function of the concentration of chromium particles suspended in a plating bath.

The present invention provides a method for producing ternary or greater alloy electrodeposits with compositions and properties similar to the bulk form of these alloys using a modified aqueous electrodeposition procedure. Essentially, the invention is a two-step process. First, the composite coating is prepared by occlusion of metal powder(s) in an electrodeposit matrix during the electrodeposition process. Second, the composite coating is heat treated to diffuse the occluded powder(s) throughout the electrodeposit, thereby forming the desired alloy.

In the first step, a conventional aqueous electrolyte is used and normal electroplating parameters for that electrolyte are maintained. In order for the metal powder(s) to be occluded during this step, the metal powder must be relatively inert to the electrolyte and sufficiently small to be dispersed in the electrolyte by mechanical stirring or other forms of agitation to achieve physical contact with the surface being coated.

In the second step, the composite coating is heat treated to diffuse the occluded metal powder(s). A time-temperature combination is used that achieves a coating homogeneity comparable to the commercial form of the alloy. If desired, a diffusion barrier coating is used between the composite coating and the substrate to control excessive interdiffusion.

Laboratory studies on the present invention were primarily applied to the electrodeposition of a stainless steel type iron-nickel-chromium coating on a mild steel substrate. The electrolysis step consists of mechanically suspending chromium powder in an iron-nickel alloy plating bath and simultaneously occluding the powder in the electrodeposit matrix. Commercially available chromium powder (99.86 pct. Cr) was used in the experiments. The chromium particles were approximately 2 μm in diameter and most of the particles were approximately spherical in shape. Image analysis of the occluded chromium powder recovered from the composite coating showed a particle size distribution matching that of the starting powder.

The equipment used for deposition of the composite coating was as follows. A plastic plating cell, 100 mm diameter and 135 mm high was used. The chromium powder was suspended in the electrolyte by means of a 50 mm diameter propeller placed near the base of the cell and rotating at 360 rpm. Two sets of 99.6 pct pure iron anodes and pure nickel anodes were positioned 30 mm from a 10 mm diameter 1020 AISI steel rod cathode. The effective plating area of the cathode was 0.13 $dm^2$. Current to each set of anodes was controlled independently by two dc power supplies connected in parallel to obtain a more uniform electric field around the cathode. This also allowed more careful control of the dissolution and deposition rates. Total coulombs passed through the cell were measured using an ampere-hour meter. A composite coating of approximately 250 μm was achieved.

The composition of the electrolyte used in the preparation of the composite coatings was as follows:

Total Metal Ion ($Fe^{2+}$, $Ni^{2+}$): 1.78 mol/L
Sulfate Ion: 1.70 mol/L
Chloride Ion: 0.18 mol/L
Boric Acid: 0.65 mol/L
Sodium Saccharin: 0.04 mol/L Although the total metal ion concentration was maintained at 1.78 mol/L, the relative composition of $Fe^{2+}$ and $Ni^{2+}$ in the electrolyte was varied in order to change the composition of Fe and Ni in the electrodeposit. Sodium saccharin was added to relieve internal stresses in the electrodeposit.

The compositions of the composite coatings were determined by dissolving the Fe-Ni alloy matrix in 10 pct $HNO_3$ and recovering the insoluble Cr powder by filtration. The dissolved Ni was determined by atomic absorption methods. Iron was calculated by difference. Hydrogen evolution was calculated from the overall efficiency of the Fe-Ni electrodeposition reaction. Iron-nickel metal deposition and hydrogen evolution were assumed to be the only electrochemical reactions. X-ray diffraction methods were used to investigate the microstructure of the composites. Scanning electron microscopic (SEM) and energy dispersive X-ray analytical (EDAX) methods were used to examine the distribution characteristics of the Cr powder within the electrodeposit.

Several factors were found to influence the rate of chromium occlusion in the iron-nickel matrix. One of the most significant factors is the volume percent of chromium particles suspended in the plating bath. In tests made with chromium particles in suspension of 0.3 to 30 vol pct powder and at 2.5 $A/dm^2$, the weight percent of the chromium particles codeposited in the base metal increases as the log of the concentration of chromium particles suspended in the plating bath. This relationship is depicted graphically in FIG. 1. Using 30 vol pct suspended chromium in a 60 mol pct ferrous-40 mol pct nickelous ion electrolyte (1.78M metal ions), a composite coating similar in composition to 18-8 stainless steel is obtained. The electrolyte compositions for this type of steel which it is desired to be protected are 20 to 55 mol pct ferrous with 45 to 80 mol pct of nickelous.

FIG. 1 shows that the percentage of Cr in the composite coatings increased significantly as the concentration of suspended Cr particles was increased above 1 or 2 vol pct. These data are consistent with a model proposed by and experimentally confirmed in N. Guglielmi, "Kinetics of the Deposition of Inert Particles from Electrolytic Baths", *J. Electrochem Soc.*, Vol. 119, No. 8, pp. 1009–1012, for the occlusion of ceramic particles in an electrodeposited Ni matrix. The model was further confirmed by J. P. Celis and J. R. Roos, "Kinetics of Alumina Particles from Copper Sulfate Plating Baths", J. Electrochem Soc., Vol. 124, No. 10, pp. 1508–1517, in their investigation of the occlusion of $Al_2O_3$ in an electrodeposited Cu matrix. The model consists of a two-step mechanism in which loosely adsorbed particles on the cathode are in equilibrium with the suspended particles. The adsorbed particles are then irreversibly occluded into the electrodeposit. The model is described by the following mathematical expression $$c/\alpha=(Wi_o/nFdV_o)(e^{(A-B)\eta})(1/k+C)$$

where C is the concentration of suspended metal particles in volume percent, d is the volume percent of particles occluded, W is the atomic weight of the deposited metal, d is the density of the electrodeposited metal matrix, n is the valence of the metal ions reduced, and F is the Faraday. K is a constant derived from the Langmuir adsorption isotherm. It is associated with the loose adsorption step and depends essentially on the intensity of the interaction between the particles and the cathode surface. The values $i_0$ and A are related to the metal deposition and are constants in the Tafel equation, which gives a relation between the current density (i) and the overpotential ($\eta$), as follows:

$$i=(i_0)\,e^{A\eta}$$

The parameters Vand B play a symmetrical role with the parameters io and A but are related to the inert particle occlusion step.

Plots of $c/\alpha$ versus C should be linear with $(Wi_o/nFdV_o)$ $(e^{(A-B)\eta})$ (1/k) as the Y intercept. The slope is equal to the term $(Wi_o/nFdV_o)(e^{(A-B)\eta})$. When $C/_\alpha$ is equal to zero, C will be equal to $-1/K$. Data from FIG. 1 plotted in this manner were linear and in agreement with the model. The intercept gave a value of $K=0.8$. In comparison, K values between 2.8 and 8.3 have been reported for the occlusion of ceramic particles in the above-mentioned articles. The quantity of loosely adsorbed Cr particles appears to be considerably less than that of the ceramic particles. As a result, more concentrated Cr powder suspensions were used to obtain more completed coverage of the cathode surface.

Because a more complex mathematical relationship exists in the binary Fe-Ni alloy plating system than in the system treated by Guglielmi, attempts were not made to relate $V_o$ and B with $i_o$ and A.

A second factor affecting the occlusion rate of chromium powder is the presence of reducible ions ($Fe^{2+}$, $Ni^{2+}$, $H^+$) in the electrolyte. Also affecting the occlusion rate is the crystallographic structure of the electrodeposited alloy matrix.

The effect of the above factors on the occlusion process was evaluated by controlling the composition of the electrolyte and the cathode current density. The importance of the presence of each reducible ion ($Fe^{2+}$, $Ni^{2+}$, $H^+$) was thus also determined.

Figure 2:
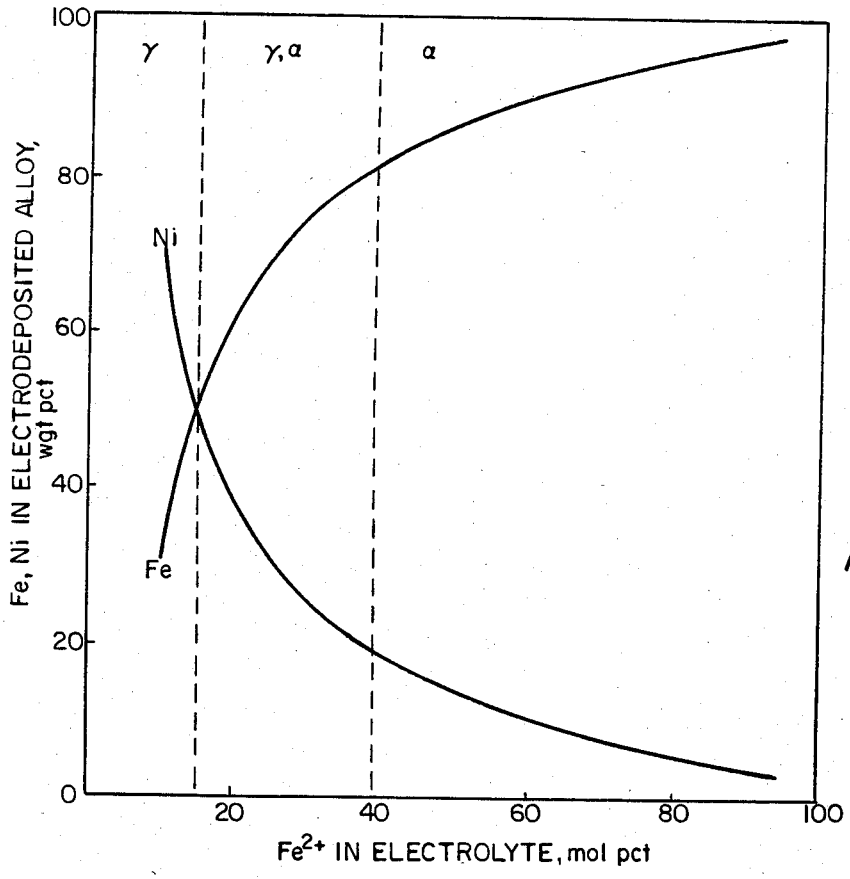
FIG. 2 is a graphical representation of the composition of the electrolyte versus the composition of the electro-deposited alloy matrix.
Figure 4:
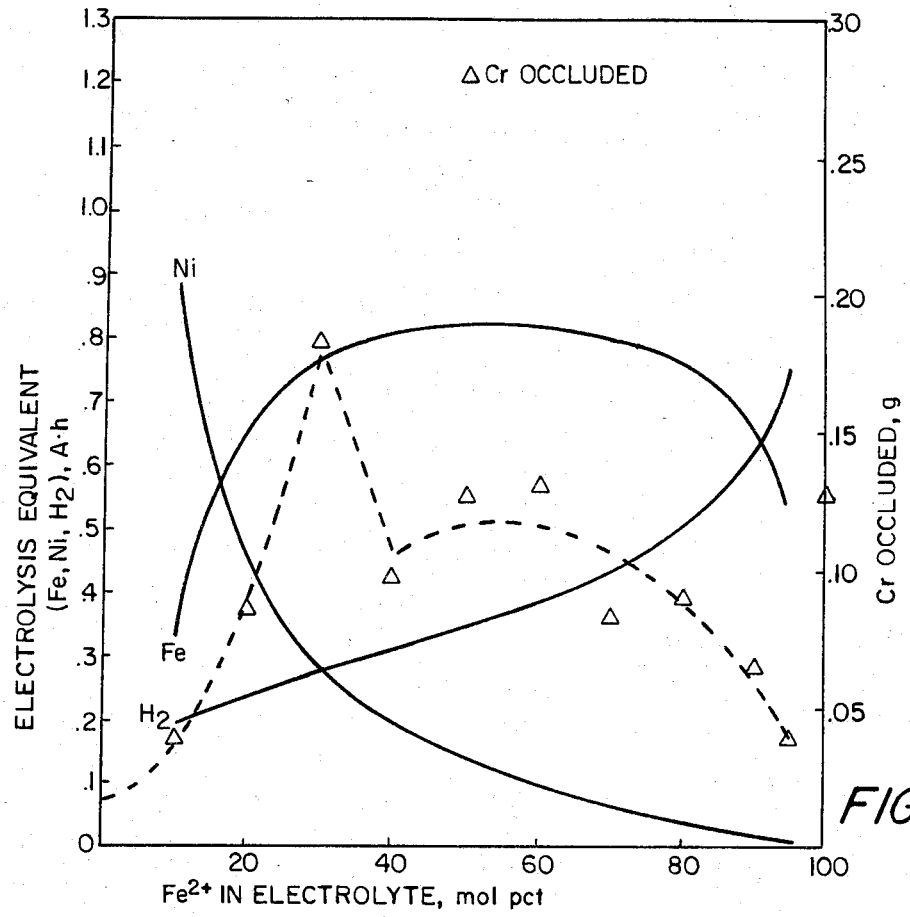
FIG. 4 is a graphical representation of the effect of electrolyte composition on the quantity of $Fe^{2+}$, $Ni^{2+}$, and $H^+$ reduced and the corresponding effect on the quantity of Cr power occluded.

FIG. 2 illustrates the change in the composition of the FE-Ni alloy matrix as the percentage of $Fe^{2+}$ in the electrolyte is increased (total $Fe^{2+}$ and $Ni^{2+}$ always equaled 1.78 mol/L). The dashed lines define compositions where the crystallographic structure of the alloy changes. X-ray diffraction data for the Fe-Ni matrix microstructure of composite coatings produced at 2 $A/dm^2$ shows that matrices containing 72 wt pct or less Fe had either a dual-phase $\gamma$(Ni, Fe)$-\alpha$(Fe, Ni) structure or a $\gamma$(Ni, Fe) structure. Matrices containing 85 wt pct or more Fe had an $\alpha$(Fe, Ni) structure. These data are Fedorova, "X-ray Diffraction Structure Investigation of Electrodeposited Iron-nickel Alloys," *Zh. Fiz. Khim,* vol. 32, 1958, pp. 1211–1213 for electrodeposited Fe-Ni alloys. According to his data, a single-phase $\gamma$(Ni, Fe) structure was obtained for electrodeposits containing less than 47 wt pct Fe, and a single-phase $\gamma$(Fe, Ni) structure was obtained for electrodeposits containing greater than 81 wt pct Fe. From Fedorova's data, a dual-phase structure would be predicted for the matrices produced at 2 $A/dm^2$ when the electrolyte contains between 15 and 40 mol pct $Fe^{2+}$. Data presented in FIG. 4 illustrate the relative importance of the reducible ions ($Fe^{2+}$, $Ni^{2+}$, $H^+$) to the Cr occlusion process and their correlation with the composition and structure of the Fe-Ni alloy matrix. In the series of tests from which these data were derived, the electrolytes contained 20 vol pct suspended Cr powder. The total charge for each deposit was 1.3 A.h at a current density of 2 A/dm$^2$.

A maximum quantity of Cr powder was occluded from an electrolyte containing 30 mol pct $Fe^{2+}$ and 70 mol pct $Ni^{2+}$. The resulting Fe-Ni matrix contained 72 wt pct Fe and 28 wt pct Ni. This maximum coincided with a dual-phase crystallographic structure in the electrodeposited matrix.

The alloy matrix of the composite coatings prepared using electrolytes containing more than 30 mol pct $Fe^{2+}$ exhibited an $\alpha$(Fe, Ni) structure. The quantity of Cr powder occluded in composites having this structure appeared to depend on the quantity of Fe deposited and appeared to reach a maximum with approximately 55 mol pct $Fe^{2+}$ in the electrolyte. At $Fe^{2+}$ concentrations above 55 mol pct, the quantity of hydrogen evolved began to increase, which correspondingly decreased the quantity of Fe deposited and powder occluded. Below 55 mol pct $Fe^{2+}$ in the electrolyte, a similar decrease in occluded Cr occurred but was associated with an increase in the quantity of nickel deposited. The quantity of Cr occluded continued to decrease until a dual-phase $\gamma$(Ni, Fe)$-\alpha$(Fe, Ni) electrodeposited matrix was obtained using approximately 40 mol pct $Fe^{2+}$ in the electrolyte.

Figure 5:
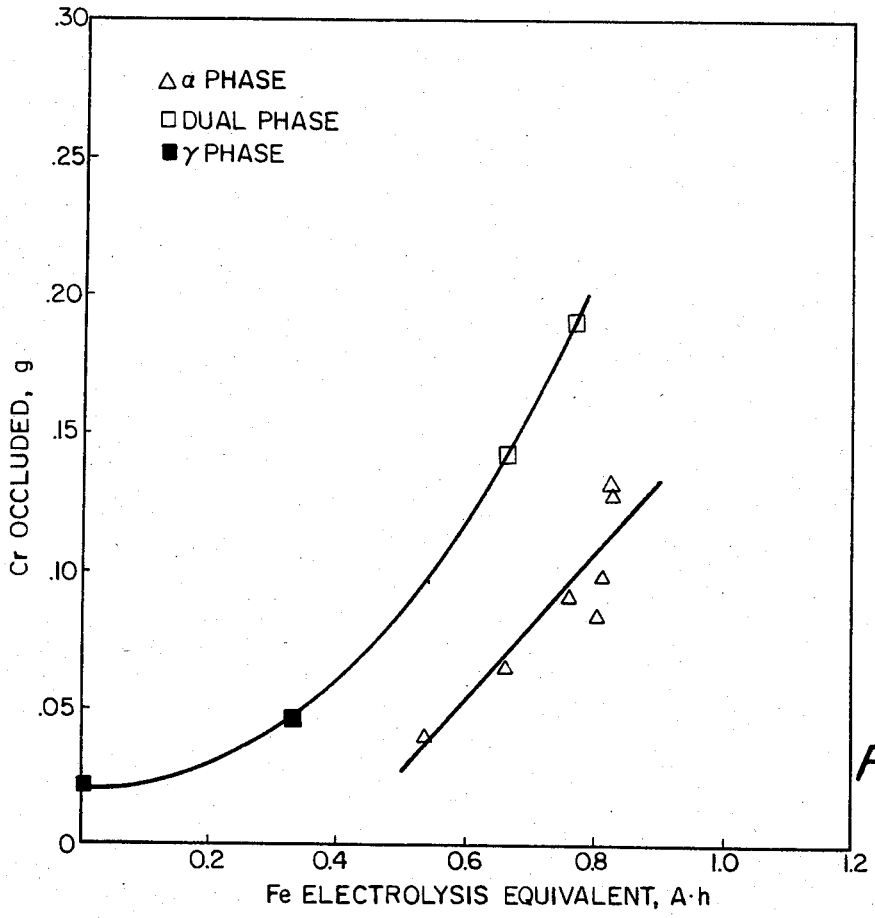
FIG. 5 is a graphical representation of the effect of the quantity of Fe deposited on the quantity of Cr powder occluded in Fe-Ni alloy matrices with different microstructures.

The relationship between Fe deposition and Cr powder occlusion is further illustrated in FIG. 5 for each of the $\alpha$, $\nu$, and dual-phase regions. Within each phase, the quantity of Cr powder occluded increased as the quantity of electrodeposited Fe increased. However, the functional dependence of Cr occlusion on Fe deposition differed in each phase.

The relative quantities of Cr occluded at 5 A/dm$^2$ over the full range of electrolyte were consistent with those obtained at 2 A/dm$^2$. Because there was a shift to more Fe deposition at higher current densities, comparable data at 5 A/dm$^2$ were obtained from electrolytes containing more $Ni^{2+}$. A maximum quantity of Cr was occluded at 5 A/dm$^2$ with an electrolyte containing 20 mol pct $Fe^{2+}$. Overall, the quantities of Cr occluded were higher at 5 A/dm$^2$.

It is also observed that the weight precent of chromium powder occluded does not vary significantly over the pH range of 1.8 to 2.2.

The successful heat treatment of an iron-nickel-chromium composite coating is accomplished at 800° to 1,100° C. using an inert atmosphere or vacuum. A heating rate of 60° to 120° C./hr is used. After heat treatment, the coatings are allowed to furnace cool under vacuum. Typical cooling rates are 1,000° C./h. A pump head vacuum level $2\times10^{-6}$ to $2\times10^{-5}$ Torr is maintained throughout the heat treatment.

The extent of coating homogenization and substrate-coating interdiffusion, as well as the deposit microstructure characteristics, were determined for heat treated coatings containing approximately 12 wt pct Cr. Each coating was prepared at 2 A/dm$^2$ using a 60 mol pct $Fe^{2+}-40$ mol pct $Ni^{2+}$ electrolyte. Cross sections of coatings before and after heat treatment of 1,100° C. for 1 h were compared. The SEM photo of the unhomogenized composite shows discrete Cr particles distributed uniformly throughout the Fe-Ni alloy matrix. An energy dispersive X-ray analysis (EDAX) map at the same location shows the occluded Cr appearing as bright areas. After heat treatment, extensive diffusion of Cr is evident. Individual 2 mm particles cannot be distinguished in the matrix. The corresponding EDAX map substantiates this result.

Figure 3:
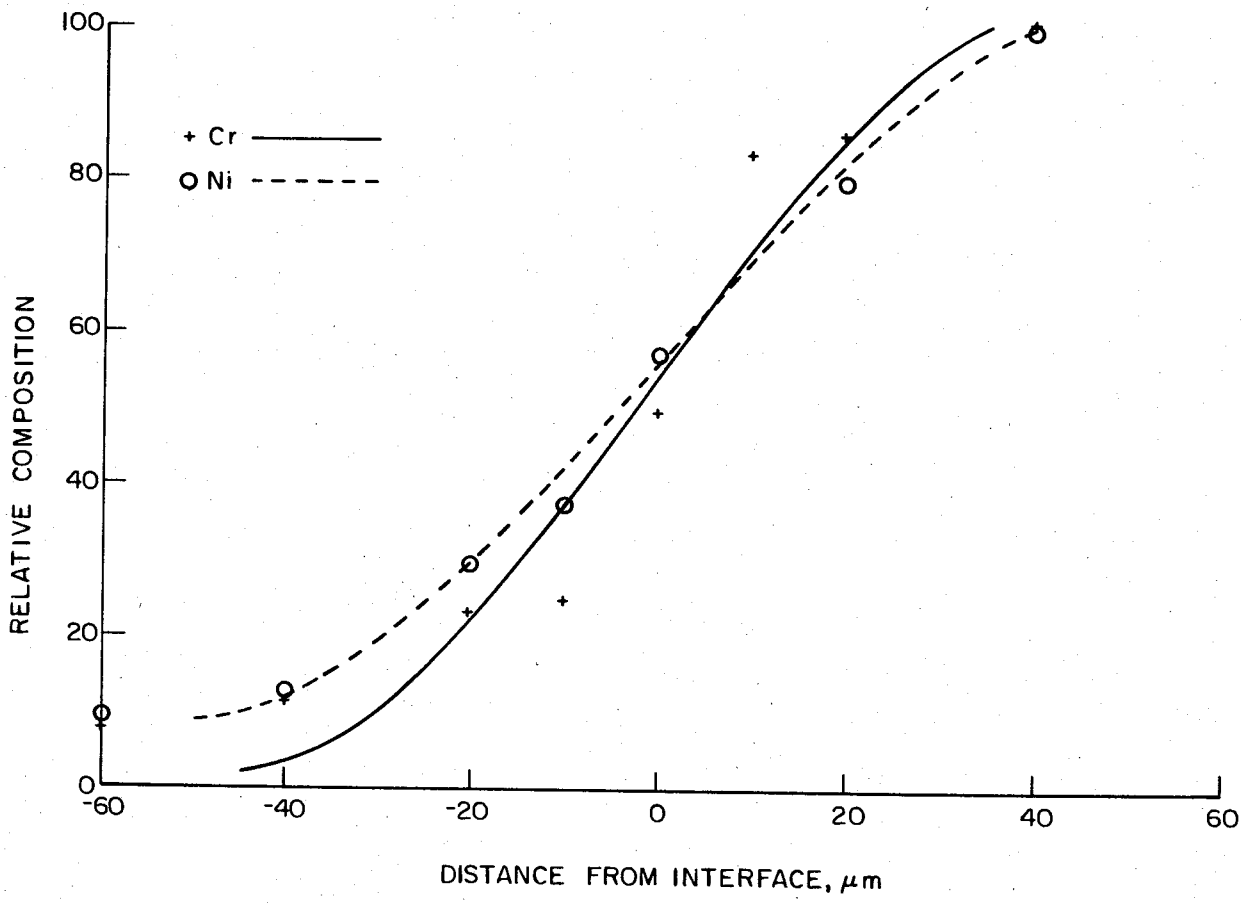
FIG. 3 is a graphical representation of the relative quantities of chromium and nickel near a substrate-coating interface.

During heat treatment, some interdiffusion of the coating and the 1020 AISI steel substrate occurred. FIG. 3 shows the relative intensities of Cr and Ni near the coating-substrate interface as determined by EDAX. A typical heat-treated coating 125 mm thick exhibits a diffusion zone approximately 80 $\mu$m wide.

Heat treatment at 800° to 1,100° C. resulted in alloy coatings with different degrees of hardness and thus different microstructures. A coating homogenized at 1,100° C. for 1 h and furnace cooled exhibited a hardness of 1,700±500 DPH. This extremely high hardness is representative of a high-carbon (greater than 0.8 pct) martensitic microstructure (17), indicating that a significant diffusion of carbon from the substrate to the coating occurred at these heat-treating conditions.

A coating homogenized at 800° C. for 1 h and annealed at 700° C. for 1 h resulted in a much softer coating with a hardness of 190±60 DPH. This value is consistent with that of martensitic-type 410 stainless steel annealed to produce a ferritic microstructure containing pearlite.

A chemical resistance test was conducted on heat-treated coatings to reveal inhomogeneity of the Cr or defects in the coating structure. During exposure to boiling $HNO_3$, the coating remained intact while the AISI 1020 substrate was dissolved.

It is anticipated that the most significant application of this invention will be in the preparation of a wide range of stainless steel type coatings for corrosion resistance. Bulk forms of stainless steels containing up to 24 pct chromium and 2 pct manganese are now used for transportation and construction purposes and for production of numerous fabricated metal parts and machine parts. Deposition of (e.g., iron-nickel-chromium) coatings on carbon steel substrates which contain no chromium and less than 1 pct manganese would result in a substantial reduction in the use of chromium and manganese.

This invention could also be used to deposit thin cobalt-based hard-facing alloys on iron-based substrates to impart abrasion, erosion, or galling resistance to the surface. Many present hard-facing procedures require multiple alloy layers (0.13 to 0.74 cm total thickness) because of alloy dilution during application. A thinner coating (less critical alloying elements) having the desired final composition of the hard facing alloy could be applied by the method of the present invention.

Thus, while the present invention has been described with respect to exemplary embodiments thereof, it will be understood by those of ordinary skill in the art that variations and modification can be effected in these embodiments within the scope and spirit of the invention.

We claim:

1. A method of coating a metal substrate with a ternary or greater alloy of a predetermined composition comprising the steps of:

determining the control parameters which are the concentrations of the metals to be deposited in the electrolyte and the current density of the matrix structure of the alloy to be electrodeposited;

electrodepositing first and second metals on the substrate using an aqueous electrolyte in accordance with the control parameters, mixing a metal powder in the electrolyte as the first and second metals are electrodeposited such that a portion of the metal powder is occluded to form an electrodeposited metal coating;

controlling the volume percent of the metal powder in the electrolyte and the percentage of reducible ions in accordance with the control parameter of the determined matrix structure to cause the metal powder to occlude with the first and second metals at a desired rate; and heat treating the metal coating to diffuse the occluded metal powder in the coating and to thereby form the desired alloy coating.

2. A method of coating as claimed in claim 1 wherein said mixing step includes the mixing of a plurality of metal powders in the electrolyte such that a portion of the plurality of the metal powders is occluded.

3. A method of coating as claimed in claim 1 further including the step of depositing a diffusion barrier coating on the metal substrate prior to electrodeposition.

4. A method of coating as claimed in claim 1 wherein the mixing step includes the mechanical stirring of the electrolyte.

5. A method of coating as claimed in claim 1 wherein the metal powder mixed in the electrolyte is relatively inert to the electrolyte.

6. A method of coating as claimed in claim 1 wherein the heat treating of the metal coating is performed in an inert atmosphere or vacuum.

7. A method of coating as claimed in claim 1 wherein the metal substrate is an iron-based metal.

8. A method of coating as claimed in claim 7 wherein the iron-based coating is stainless steel, wherein the electrolyte includes an iron-nickel plating solution, and wherein the metal powder is chromium.

9. A method of coating as claimed in claim 8 and further including the step of controlling the percentage of $Fe^{2+}$ reducible ion in the electrolyte to cause the chromium powder to occlude with the electrodeposited iron-nickel metal at a desired rate.

10. A method of coating as claimed in claim 9 wherein the heat treating of the metal coating is performed at 800° to 1,100° C. in an inert atmosphere or vacuum.

11. The method of claim 8 wherein the current density is raised from 2.0 go to 5.0 $A/dm^2$ to obtain the desired occlusion of the chromium powder.

12. The method of claim 8 wherein the electrolyte contains 20 to 55 mol pct ferrous ion and 45 to 80 mol pct nickelous ion.

* * * * *